United States Patent [19]

Zuchtriegel

[11] Patent Number: 4,710,682

[45] Date of Patent: Dec. 1, 1987

[54] FLUORESCENT LAMP OPERATING CIRCUIT

[75] Inventor: Anton Zuchtriegel, Taufkirchen, Fed. Rep. of Germany

[73] Assignee: Patent-Treuhand-Gesellschaft fur elektrische Gluhlampen m.b.H., Munich, Fed. Rep. of Germany

[21] Appl. No.: 23,456

[22] Filed: Mar. 9, 1987

[30] Foreign Application Priority Data

Mar. 14, 1986 [DE] Fed. Rep. of Germany ..... 3608615

[51] Int. Cl.[4] ..... H05B 37/00

[52] U.S. Cl. ..... 315/224; 315/210; 315/226; 315/242; 315/244; 315/290; 315/DIG. 7

[58] Field of Search ..... 315/224, 226, 290, 242, 315/244, 210

[56] References Cited

U.S. PATENT DOCUMENTS

| | | | |
|---|---|---|---|
| 4,346,332 | 8/1982 | Walden | 315/307 |
| 4,438,372 | 3/1984 | Zuchtriegel | 315/224 |
| 4,477,748 | 10/1984 | Grubbs | 315/306 |
| 4,481,460 | 11/1984 | Kröning et al. | 323/266 |

OTHER PUBLICATIONS

"SIPMOS Transistors", SIEMS Application Notes, 1983, chapter 1.9, "Electronic Ballast for Fluorescent Lamps", pp. 34 et seq.

"Elektronischaltungen", (Electronic Circuits) by Walter Hirschmann, published by SIEMENS, AG, chapter B3.12, Elektronisches Vorschaltgerat fur neue Leuchtstofflampen, pp. 147–151.

*Primary Examiner*—Harold Dixon

*Attorney, Agent, or Firm*—Frishauf, Holtz, Goodman & Woodward

[57] ABSTRACT

A circuit for operating low-pressure discharge lamps at elevated frequency comprises a reconnect circuit which disables the disconnect circuit upon exchange of a defective low-pressure discharge lamp (LP1). The disconnect circuit comprises a diode (D10), a resistor (R11) and a thyristor (TH) together with a trigger circuit (5). The reconnect circuit comprises a capacitor (C9) and a resistor (R12). Upon removal of the defective low-pressure discharge lamp (LP1), the capacitor (C9) is charged over the resistor (R12). Upon insertion of a new low-pressure discharge lamp (LP1), the capacitor (C9) is discharged and recharged in opposite direction and the holding current is removed from the thyristor (TH). This causes the thyristor (TH) to block, and enables the push-pull frequency generator (3) to start oscillating again.

6 Claims, 3 Drawing Figures

FLUORESCENT LAMP OPERATING CIRCUIT

Reference to related literature:

U.S. Pat. No. 4,438,372, Zuchtriegel, assigned to the assignee of the present application, the disclosure of which is hereby incorporated by reference.

U.S. Pat. No. 4,481,460, the disclosure of which is hereby incorporated by reference.

"SIPMOS Transistors", SIEMENS Application Notes 1983, chapter 1.9, "Electronic ballast for fluorescent lamps", pp. 34 et seq., and equivalent general disclosure "Elektronischaltungen" ("Electronic Circuits") by Walter Hirschmann, published by SIEMENS AG, chapter B3.12, "Elektronisches Vorschaltgerät für neueLeuchtstofflampen" ("Electronic Ballast for New Fluorescent Lamps") 50 W/220 V, a-c, pp. 147 to 151.

The present invention relates to circuits to operate one or more low-pressure discharge lamps, typically fluorescent lamps and more particularly to an arrangement to permit automatic restarting of a lamp in an energized operating circuit after a lamp has been removed from the lamp socket, for example due to malfunction of the lamp.

BACKGROUND

The referenced U.S. Pat. No. 4,438,372, Zuchtriegel, assigned to the assignee of the present application, the disclosure of which is hereby incorporated by reference, describes a circuit to operate one or more fluorescent lamps at a frequency which is above network or power frequency. The received power frequency, at 50 or 60 Hz, depending on national standard, is rectified, and then converted to a much higher frequency. It has been found that fluorescent lamps operate more efficiently at frequencies substantially higher than network power frequency.

The circuit, as described in the referenced literature and patents, utilizes, hence, a power network rectifier to which a push-pull frequency of two alternatingly switching transistors is connected. A control circuit is provided to control the transistors for alternate switching. A center junction between the transistors forms one terminal of the supply circuit to the fluorescent lamp or lamps. Each one of the fluorescent lamps has a series resonance circuit associated therewith, which includes a resonance inductance, a coupling capacitor and a resonance capacitor. The supply lines for the fluorescent lamps are connected to a first electrode via the coupling capacitors and the resonance inductances to connect to the center junction between the two transistors. A further line from the second electrode of the lamps is connected to the negative terminal of the power network rectifier. To remove operating power from the lamps, for example if one of the lamps should burn out or is to be replaced, a turn-off circuit is provided which includes a diode in series with a resistor and a thyristor with a trigger circuit which connects the base of the transistor connected to the positive terminal of the power rectifier with the negative terminal of the power rectifier, through a resistor which, in turn, is connected to the positive terminal of the power rectifier and to the center junction between the diode and the other resistor. A reenergization circuit is likewise provided.

The basic circuit, without the turn-off and the reenergization circuit, is described in the Siemens literature, for example in the book "Elektronischaltungen" ("Electronic Circuits") by Walter Hirschmann, chapter B3.12, pp. 147–151, "Elektronisches Vorschaltgerät für neue Leuchtstofflampen" ("Electronic Ballast Circuit for New Fluorescent Lamps") 50 W/220 V. This detailed description is also reflected in the English-language literature without, however, all the theoretical considerations, see Siemens publication "SIPMOS Transistors, SIEMENS Application Notes 1983".

The connection of the fluorescent lamp or lamps can be placed, selectively, between the positive terminal of the power rectifier and the center junction between the serially connected switching transistors, or between the center junction of the two transistors and the negative terminal of the power rectifier. It has been found preferable to connect the fluorescent lamps in parallel with the center junction between the two transistors and the negative terminal of the power rectifier, as will be described in detail below.

U.S. Pat. No. 4,438,372, Zuchtriegel, assigned to the assignee of the present application, the disclosure of which is hereby incorporated by reference, describes a similar ballast or energizing circuit having a self-starting push-pull switching arrangement. The network circuit, including the push-pull switch, further includes a disconnect circuit, as described above. In case a lamp is defective, the push-pull switching circuit is disabled by firing of the thyristor. After the lamp, which may be a single lamp or one of a plurality of lamps, has been replaced, the push-pull circuit will not start on its own. It is necessary first to remove the holding or firing current from the thyristor, so that the thyristor can revert to blocking state. Consequently, if for example one lamp of a plurality of lamps has to be disconnected or replaced, it is necessary to first switch off the circuit for all the lamps in which it is used, before the circuit can be restarted, by starting the push-pull oscillator again to generate oscillations.

U.S. Pat. No. 4,481,460 describes an inverter with a disconnect circuit which is particularly designed for use with discharge lamps with heatable electrodes. A thyristor is used as a switching element for a disconnect or turn-off circuit connected in the heating circuit of the lamp. The thyristor connects the negative terminal of the power rectifier with the lamp heater circuit. The thyristor receives a holding current from the electrode closest to the charge capacitor. A disconnect winding of the saturation transformer is coupled in parallel with the thyristor via diodes and the starting capacitor is coupled in parallel with the thyristor via a resistor. In this disconnect circuit, it is not necessary to disconnect the alternating current power supply after exchange of a lamp in order to permit the inverter to start again. When a defective lamp is removed, the thyristor also loses its holding current, so that it will revert to blocking state.

THE INVENTION

It is an object to provide a circuit for use with a fluorescent lamp or fluorescent lamps as described, for example in the referenced Zuchtriegel U.S. Pat. No. 4,438,372, which provides for self-restarting of the circuit by immediately generating again oscillations by the oscillator. Consequently, the respective lamp or lamps will reignite rapidly and interruption of network supply power is not needed.

Briefly, a restarting circuit is provided, used with the circuit, for example as described in the referenced Zuchtriegel U.S. Pat. No. 4,438,372, which includes a capacitor and a resistor. The capacitor is connected to the heater terminal of the electrode the other terminal of which is connected directly to the negative terminal of the power rectifier. The other terminal of the capacitor is connected to the center junction between the diode and the resistor of the turn-off circuit which includes the thyristor. The resistor of the restarting circuit is connected to the center junction between the capacitor and the heater terminal of the electrode and to the positive terminal of the power network rectifier.

The system has the advantage that by mere inversion of the polarity of charge being applied to the capacitor, the thyristor will change from conductive to blocked state since the holding or through-current through the thyristor will be removed, so that the frequency generator will, on its own, start oscillating again. Thus, automatic restarting of the circuit is insured.

DRAWINGS

DETAILED DESCRIPTION

Figure 1:
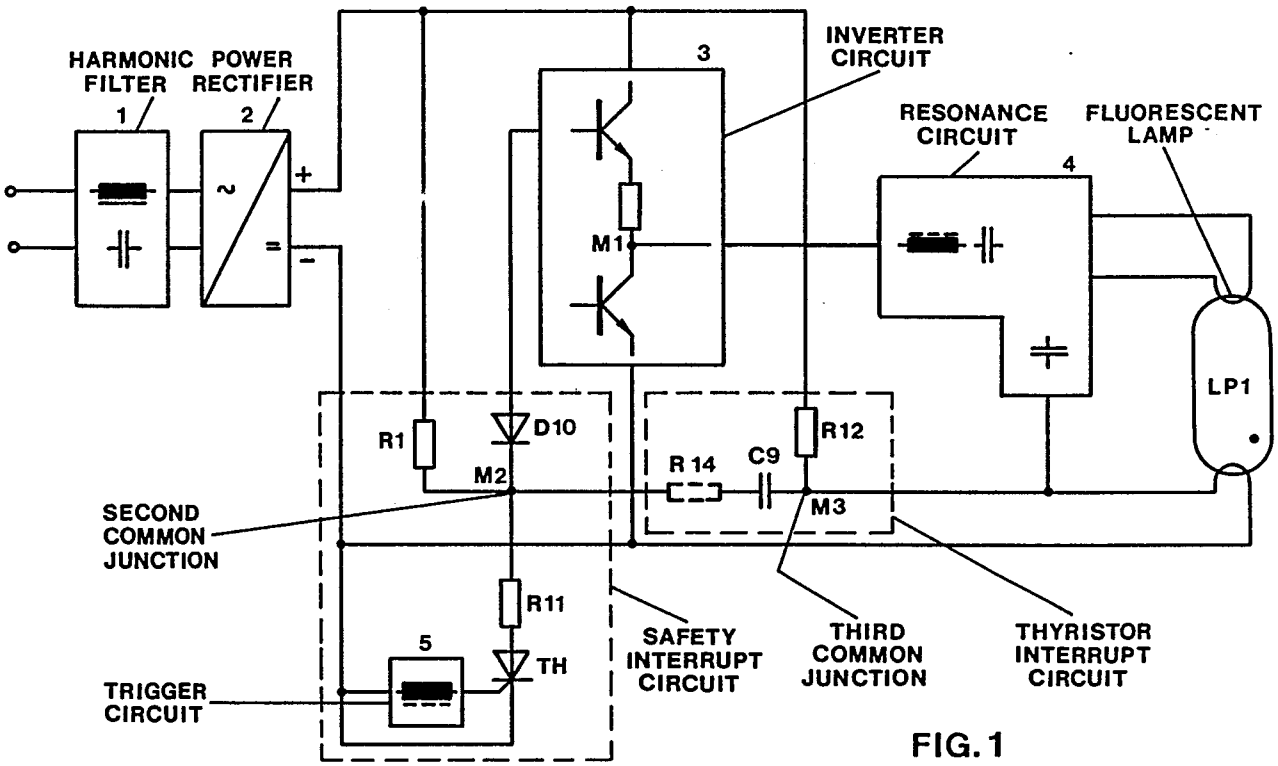
FIG. 1 is a schematic general block circuit diagram of a basic fluorescent lamp circuit in which the circuit components and features in accordance with the present invention are shown in detail, the remainder of the circuit being generally illustrated in block diagram form only.

Referring first to FIG. 1, which shows the general structure of the circuit to which the present invention relates, and the improvement of the present invention.

A harmonic filter 1 is connected to an alternating current power network, for example of 50 or 60 Hz, which, in turn, is connected to a rectifier 2. The output of the rectifier 2, that is, its positive and negative terminal, are connected to a push-pull frequency generator 3 forming an inverter circuit having a control circuit to control the frequency thereof. The frequency generator 3 has two switching transistors of the same type which bridge across the outputs of the rectifier. The emitter-collector paths of the switching transistors are connected to a common junction M1. A low-pressure discharge lamp, typically a fluorescent lamp, LP1, is connected between the common junction M1 between the transistors and the negative terminal of the power rectifier 2. A series resonance circuit 4 is connected in the circuit to the lamp LP1. To disconnect the lamp LP1, a safety interrupt, or disconnect circuit is provided formed by a diode D10, a resistor R11 and a thyristor TH, together with a trigger circuit 5. The series circuit of diode resistor and thyristor TH is connected to the base of the switching transistor which is connected to the positive terminal of the power rectifier 2. A second common junction M2 between the diode D10 and the resistor R11 is connected over a resistor R1 with the positive terminal of the power rectifier 2.

In accordance with a feature of the invention, a reconnect circuit is provided, formed by a capacitor C9 and a resistor R12. The capacitor C9 is connected to the junction M2 between the diode D10 and the resistor R11 and to the heater terminal of the electrode of the lamp, the other terminal of which is connected to the negative terminal of the power rectifier 2. The resistor R12, connected to a third common junction M3 between the capacitor C9 and the electrode terminal of the lamp, is further connected to the positive terminal of the power rectifier 2. A further resistor R14 may be used, connected between the second terminal of the capacitor C9 and the junction M2, as shown in FIG. 1. Resistor R14 is shown in broken lines since it is not strictly necessary.

Operation: If there should be malfunction or removal of the lamp LP1, the trigger circuit 5 of the thyristor will cause the thyristor to become conductive. The trigger circuit itself is coupled by an inductance to the series inductance forming part of the circuit 4 and connected to the lamp LP1. Upon firing of thyristor TH, the base of the transistor connected to the positive terminal of the power rectifier will lose control power since, in effect, it will be connected to the negative terminal of the power rectifier or, in other words, will be effectively grounded. The transistor will block and oscillation of the push-pull frequency generator 3 will cease. The diode D10 in the anode circuit of the thyristor blocks alternating current; the resistor R11 is a current limiting resistor. Resistor R1 provides continued current to the anode of the thyristor so that, after becoming conductive, it does not revert to blocked condition.

Upon removal of the lamp LP1, or other lamps connected in parallel, as will appear, capacitor C9 will be charged over resistor R12. This occurs in a few seconds. Upon insertion of a new fluorescent lamp into the appropriate sockets, the positively charged surface of the capacitor C9 is connected via the electrode of the lamp LP1 to the negative terminal of the rectifier which causes discharge of the capacitor C9 and recharge in opposite direction by removal of holding current from the thyristor TH. The time constant for the thyristor to change state is determined by the time constant of the capacitor C9 and resistor R11, and is usually less than 0.1 millisecond. If it is desired to extend the recharging time, resistor R14 may be used; this somewhat increases the reliability of the transition of the thyristor TH into blocked condition.

Figure 2:
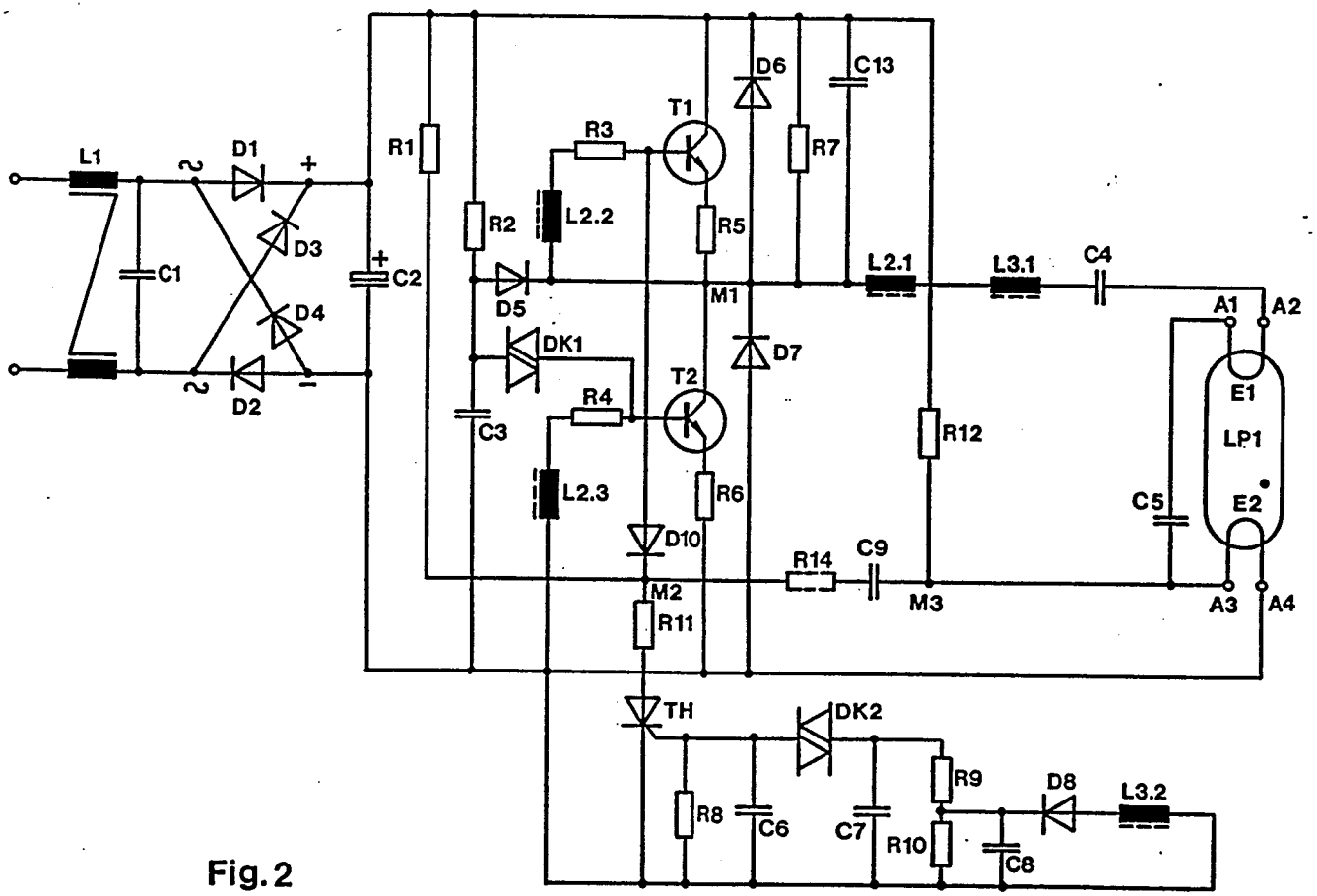
FIG. 2 is a detailed circuit diagram of the circuit of the present invention together with a supply circuit for one fluorescent lamp.

The exact circuit diagram is shown in FIG. 2. The filter is formed by a choke L1 and a capacitor C1 in parallel to the input to the rectifier. The harmonic filter is connected to the rectifier formed by diodes D1 to D4. A smoothing capacitor C2 is connected in parallel to the output of the rectifier.

The frequency generator is a push-pull frequency circuit having the two transistors T1, T2, feedback diodes D6, D7, base resistors R3, R4, emitter-resistors R5, R6, and a starting generator having resistors R2, R7, a capacitor C3 and a diac DK1. A capacitor C13 controls the steepness of the flank. The control circuit includes an inductance, in the form of transformer coils, having primary windings L2.1 and secondary windings L2.2 and L2.3. The lamp LP1 has one terminal A2 of the electrode E1 connected to the junction M1 between the transistors T1, T2 and the terminal A4 of the other electrode A2 connected to the negative terminal of the power rectifier. This connection provides for safety and reliability in operation. Further, a series resonance circuit formed by resonance inductance L3.1, resonance capacitor C5 and coupling capacitor C4 is provided. The resonance inductance L3.1 and coupling capacitor C4 are connected between the primary winding L2.1 of the control transformer, and the terminal A2 of the electrode E1 of the lamp LP1. Capacitor C5, connected to electrode terminals A1 and A3 of the electrodes E1 and E2, forms the series resonance capacitor in the preheating circuit of the lamp LP1.

The operation of such a circuit using a push-pull frequency generator and a series resonance circuit to start and operate a fluorescent lamp is well known and described, for example, in the literature reference "Electronic Circuits" by Walter Hirschmann, page 148, and need not be described in greater detail, as well as in U.S. Pat. No. 4,438,372, assigned to the assignee of the present application.

The circuit, additionally, includes a disconnect arrangement which is formed by a series circuit of a diode D10, a resistor R11 and a thyristor TH, together with a trigger circuit. The series circuit connects the base of the transistor T1, that is, the transistor connected to the positive terminal of the power rectifier, with the negative terminal of the power rectifier. The junction M2 between the diode D10 and resistor R11 is connected over a resistor R1 with the positive terminal of the power rectifier. The trigger circuit for the thyristor is formed by a secondary winding L3.2, a diac DK2, capacitors C6 to C8, as well as by resistors R8 to R10. The structure and function of such a trigger circuit is explained in the referenced U.S. Pat. No. 4,438,372, the disclosure of which is hereby incorporated by reference, and assigned to the assignee of the present application. It is known and is not part of the present invention.

In accordance with a feature of the invention, a reconnect circuit is provided formed by the capacitor C9 and the resistor R12. This circuit interrupts conduction of thyristor TH, and may also be termed a thyristor interrupt circuit. Capacitor C9 connects the center tap or junction M2 between the diode D10 and resistor R11 with the terminal A3 of the electrode E2. The resistor R12 provides for application of d-c voltage from the power rectifier to the junction M3 between the capacitor C9 and the electrode terminal A3.

The values of the various circuit elements to operate a 50 W fluorescent lamp are shown in the Table I, forming part of this specification.

Operation: Let it be assumed that the lamp LP1 fails, for example by loss of vacuum due to leaks, used emitter material, or the like. The resonance circuit 4 (FIG. 1), and specifically the element L3.1 (FIG. 2), will have an increase in voltage thereacross due to the free resonance. By transfer or transformer effect due to the secondary winding L3.2 in the trigger circuit, the diac DK2 will reach the breakdown voltage after a time determined by the RC value R9, C7, which causes the thyristor TH to fire. Upon firing, the base of the transistor T1 will lose control voltage by drainage to the negative terminal of the power rectifier through the now conductive thyristor TH. The push-pull oscillator will cease oscillating. The thyristor TH will receive holding current through the resistor R1 to hold it in conductive state.

Let it be assumed, then, that the defective fluorescent lamp is removed. The circuit, in accordance with the present invention, will then operate this way: Within a few seconds, capacitor C9 will be charged over resistor R12 to the d-c voltage output from the rectifier 2. After insertion of a new fluorescent lamp, the positively charged surface of the capacitor C9 is connected to the negative terminal through the electrode E2 of the now replaced fluorescent lamp. This causes discharge and recharge in opposite direction of the capacitor C9 by removal of the holding current from the thyristor TH so that the thyristor TH, dependent on the time constant defined by the capacitor C9 and the resistor R11, will change to blocked condition. This time constant is usually less than 0.1 millisecond. Insertion of the resistor R14 increases this recharging time of the capacitor C9, and the reliability of transistion of the thyristor TH into blocked condition.

Figure 3:
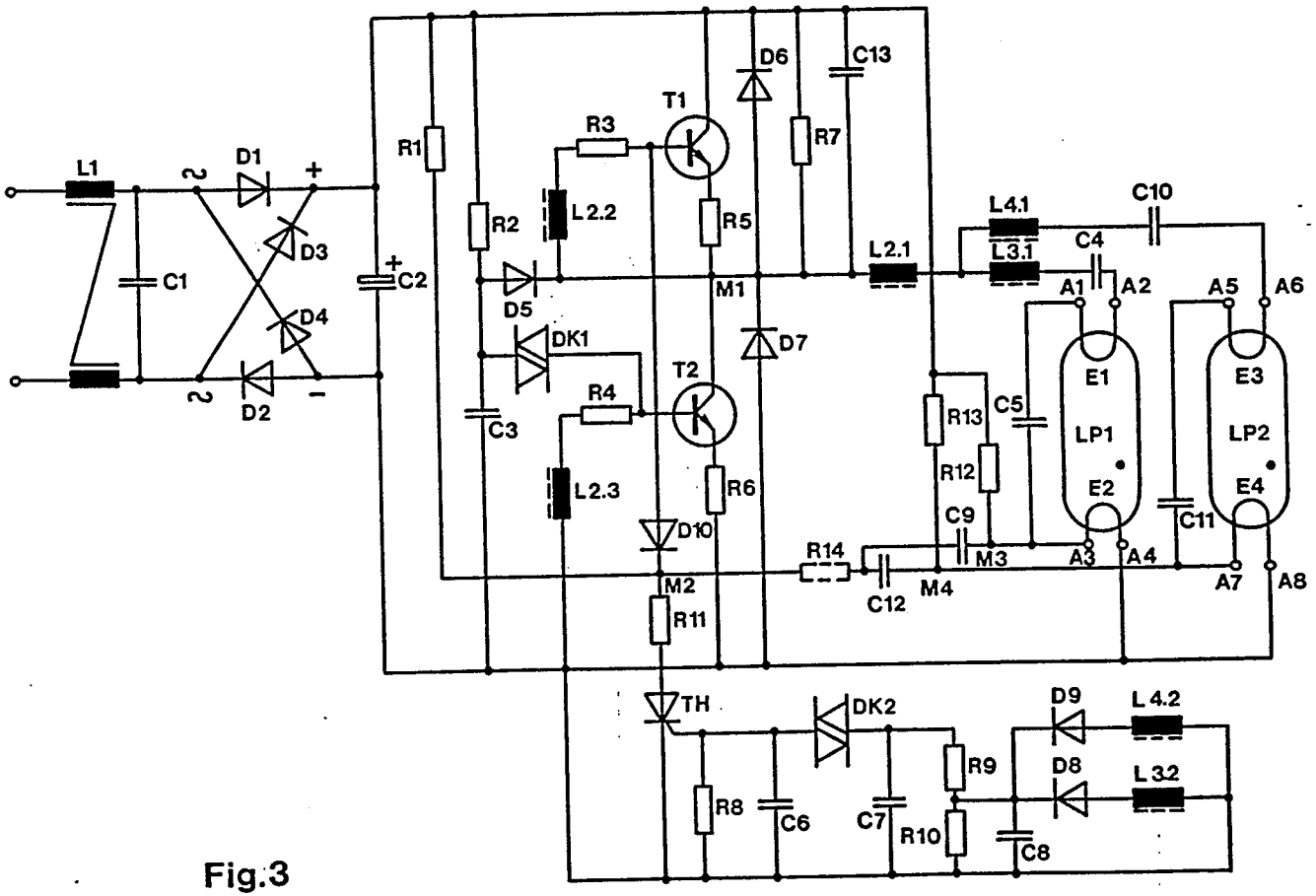
FIG. 3 illustrates the circuit of the present invention for use with two fluorescent lamps connected in parallel.

Embodiment of FIG. 3: FIG. 3 shows the circuit of the present invention applied to a plurality of lamps, there two fluorescent lamps, connected in parallel. Essentially, the circuit is the same as that shown in FIG. 2, and only the additional features, which have been given additional reference numerals, will be described.

A second lamp LP2 is connected in parallel with lamp LP1. Lamp LP2 has electrodes E3, E4. An individual, that is, a second resonance series circuit formed by the resonance inductance L4.1 is provided, the series circuit further including coupling capacitor C10 and resonance capacitor C11. The series circuit formed by the coupling capacitor C10 and the inductance L4.1 is connected to the electrode terminal A6 of the lamp LP2, and to the primary control winding L2.1. The resonance capacitor C11 is connected between the heater terminals A5, A7 of the respective electrodes E3, E4 of lamp LP2. The connection A8 from the electrode E4 of lamp LP2 is connected directly to the negative terminal of the power rectifier.

The trigger circuit includes two secondary windings, that is, an additional secondary winding L4.2, serially connected with a diode D9. The circuit D9 - L4.2 is connected in parallel to the first secondary winding L3.2 and diode D8.

An individual reconnection circuit is provided for the further fluorescent lamp, here lamp LP2, formed by capacitor C12 and resistor R13. Capacitor C12 is connected between the junction M2 of the disconnect circuit and the terminal A7 of lamp LP2 in the preheater circuit thereof. Resistor R13 is connected to the positive terminal of the power rectifier. A junction M4, similar to junction M3, is formed between the capacitor C12 and resistor R13 and the heater or electrode terminal A7 of lamp LP2.

As can be seen, the circuit will cause the thyristor TH to unblock if a defective lamp—regardless of whether it is LP1 or LP2, or both—has caused first disconnection of oscillations by conduction of the thyristor TH and, after replacement of the defective lamp or lamps, restarting by blocking the thyristor TH, by withdrawing holding current therefrom due to the recharging of capacitor C9, or C12, or both in opposite direction.

More than two lamps may be operated from the push-pull power amplifier, each additional lamp being provided with its own series resonance circuit and its own restarting circuit, as described in connection with lamp LP2.

Various changes and modifications may be made within the scope of the inventive concept.

TABLE I

| | |
|---|---|
| L1 | choke: $U_D$ = 110 V, $I_D$ = 270 mA |
| C1 | 1.1 μF, 250 V~ |
| D1-D4 | bridge-connected rectifier B 250, C 1000 |
| C2 | 10 μF, 450 V− |
| R1 | 100 kΩ, 2 W |
| R2 | 450 kΩ, 0,5 W |
| C3 | 0.1 μF, 100 V− |
| D5 | BY289 |
| DK1 | A9903 |
| R3, R4 | 10 Ω, 0.5 W |

TABLE I-continued

| | |
|---|---|
| R5, R6 | 1 Ω, 0.5 W |
| T1, T2 | MJE 13007 |
| D6, D7 | BY291, 400 V |
| R7 | 390 kΩ, 0.5 W |
| C13 | 3.3 nF, 400 V~ |
| L2.1 | ring core 13 × 7 × 5 (N27) 3 windings 0,5 mm ∅ |
| L2.2, L2.3 | 1 winding 0.5 mm ∅ |
| L3.1 | RM 12 $A_L$ 160 (N41) 75 windings/30 × 0.1 0.9 mH 60 kHz |
| L3.2 | 3 windings, 0,2 mm ∅ |
| C4 | 0.33 μF, 400 V− |
| C5 | 6.8 nF, 1500 V− |
| D10 | 1N4005 |
| R11 | 120 Ω, wire resistor 1 W |
| TH | TIC P106 M |
| R8 | 1 kΩ, 0.3 W |
| C6 | 68 nF, 60 V− |
| DK2 | A9903 |
| C7 | 0.68 μF, 60 V− |
| R9 | 470 kΩ, 0.3 W |
| R10 | 5 MΩ, 0.3 W |
| C8 | 150 pF, 100 V− |
| D8 | 1N4148 |
| C9 | 47 nF, 400 V− |
| R12 | 2.2 MΩ, 0,5 W |
| R14 | 1 bis 10 kΩ |

I claim:

1. Automatically restarting operating circuit for a low-pressure discharge lamp, such as a fluorescent lamp, for operation of the lamp with alternating current at a frequency high with respect to the frequency of a power network, having a power rectifier (2) adapted for connection to the power network;

a push-pull inverter circuit (3), connected to the rectifier (2) and including serially connected, alternately switching transistors (T1, T2) having a common junction (M1), and connected across the power rectifier (2), and a control circuit for alternately controlling the transistors to conduct or block;

a series resonance circuit (4) associated with the low-pressure lamp (LP1, LP2) including a resonance inductance (L3.1, L4.1), and a coupling capacitor (C4, C10) and a resonance capacitor (C5, C11);

a connection network interconnecting the series resonance circuit and the low-pressure lamp including a connection circuit connecting a first electrode (E1, E3) of the lamp to the coupling capacitor (C4, C10) and the resonance inductance (L3.1, L4.1) with the common junction (M1) of the switching transistors (T1, T2);

a second connection circuit connecting the second electrode (E2, E4) of the lamp with the negative terminal of the power rectifier (2); and a safety interrupt circuit to remove the current from the electrode terminals of the lamp upon failure or removal of the lamp including a series bypass circuit having a diode (D10) and a resistor (R11), said diode and resistor forming a second common junction (M2) and a main current path of a thyristor (TH) connected to the base of that one switching transistor (T1) which is connected to the positive terminal of the power rectifier (2), and the negative terminal of the power rectifier (2), a trigger control circuit (5) for the thyristor (TH) and connected to the gate of the thyristor, and a holding circuit including a holding resistor (R1) coupled to the positive terminal of the power rectifier (2) and said second common junction (M2) between the control circuit resistor (R11) and the control circuit diode (D10), and comprising, in accordance with the invention, a circuit to interrupt conduction of the thyristor (TH) after firing thereof due to the removal of the holding current from the thyristor, including a thyristor, disconnect capacitor (C9, C12) and a disconnect resistor (R12, R13), said disconnect capacitor and resistor having a third common junction (M3);

the thyristor disconnect capacitor (C9, C12) having a free terminal connected to said second common junction (M2) between the series circuit diode (D10) and series circuit resistor (R11) of the thyristor disconnect circuit;

the disconnect resistor (R12, R13) having the free terminal connected to the positive terminal of the power rectifier (2);

and said third common junction (M3) between the thyristor disconnect capacitor (C9, C12) and the thyristor disconnect resistor (R12, R13) being connected to one of the heater electrode terminals (A3, A7) of that one of the electrodes (E2, E4) of the lamp (LP1, LP2) which has its other terminal (A4, A8) directly connected to the negative terminal of the power rectifier (2), to discharge, and recharge in opposite direction of the thyristor disconnect capacitor (C9, C12) upon reinsertion of a lamp (LP1, LP2) in the circuit and thereby withdraw holding current from the disconnect thyristor (TH) and permit the alternating switching transistors (T1, T2) to resume oscillation.

2. The circuit of claim 1, further including a timing resistor (R14) connected between the free terminal of the thyristor disconnect capacitor (C9, C12) and the second common junction (M2).

3. The circuit of claim 1, wherein two lamps (LP1, LP2) are provided;

and each one of said lamps having associated therewith an individual circuit to interrupt conduction of the thyristor (TH), and each including a thyristor disconnect capacitor (C9, C12) and a thyristor disconnect resistor (R12, R13), connected together at an individual third common junction (M3, M4).

4. The circuit of claim 3, wherein said timing resistor (R14) is connected to both the free terminals of the thyristor disconnect capacitors (C9, C12) and is a common resistor for both said thyristor disconnect capacitors.

5. The circuit of claim 1, wherein a plurality of lamps (LP1, LP2) are provided, each having an individual series resonance circuit (4) associated therewith, and each having an individual circuit to interrupt conduction of the thyristor (TH) associated therewith, including an individual thyristor disconnect capacitor (C9, C12), an individual thyristor disconnect resistor (R12, R13), said disconnect capacitors and resistors being respectively, connected to individual common junctions (M3, M4).

6. The circuit of claim 5, further including a common timing resistor (R14) connected to the free terminals of said individual thyristor disconnect capacitors (C9, C12) and to said second common junction (M2).

* * * * *